US008440024B2

(12) United States Patent
Büsing et al.

(10) Patent No.: US 8,440,024 B2
(45) Date of Patent: May 14, 2013

(54) WATER-BEARING HOUSEHOLD APPLIANCE WITH A PERIODICALLY OPERATED WATER INLET VALVE

(75) Inventors: Johannes Büsing, Emersacker (DE); Georg Curtius, Dillingen (DE); Bernd Hesterberg, Heidenheim (DE); Christian Wirth, Dillingen (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 1005 days.

(21) Appl. No.: 12/517,436

(22) PCT Filed: Nov. 28, 2007

(86) PCT No.: PCT/EP2007/062926

§ 371 (c)(1),
(2), (4) Date: Jun. 3, 2009

(87) PCT Pub. No.: WO2008/077711

PCT Pub. Date: Jul. 3, 2008

(65) Prior Publication Data

US 2010/0065085 A1 Mar. 18, 2010

(30) Foreign Application Priority Data

Dec. 22, 2006 (DE) ..... 10 2006 061 080

(51) Int. Cl.

| | |
|---|---|
| ***B08B 7/04*** | (2006.01) |
| ***B08B 9/20*** | (2006.01) |
| ***B08B 3/00*** | (2006.01) |

(52) U.S. Cl.

USPC ..... 134/18; 134/25.2; 134/57 R; 134/58 R

(58) Field of Classification Search ..... 134/25.2, 134/18, 58 D, 57 D, 201, 42, 198
See application file for complete search history.

(56) References Cited

U.S. PATENT DOCUMENTS

| | | | | |
|---|---|---|---|---|
| 4,184,347 | A * | 1/1980 | Tobita et al. | 68/12.23 |
| 5,689,846 | A * | 11/1997 | Cheyne et al. | 8/158 |
| 5,722,263 | A | 3/1998 | Tassotti | |
| 5,797,996 | A * | 8/1998 | Milocco et al. | 134/18 |
| 7,578,018 | B2 * | 8/2009 | Choi | 8/158 |
| 2004/0099287 | A1 * | 5/2004 | Shin | 134/18 |
| 2004/0154644 | A1 | 8/2004 | Kim | |

FOREIGN PATENT DOCUMENTS

| | | | |
|---|---|---|---|
| DE | 19548513 | A1 | 6/1997 |
| DE | 19824403 | A1 | 12/1999 |

* cited by examiner

*Primary Examiner* — Michael Kornakov
*Assistant Examiner* — Arlyn I Rivera-Cordero
(74) *Attorney, Agent, or Firm* — James E. Howard; Andre Pallapies

(57) ABSTRACT

A water-bearing household appliance such as a dish washing machine or washing machine is provided that has a water supply system, an electrically operable electromagnetic water inlet valve for controlling the water supply, and a control unit operating a control program that controls the water inlet valve. The water inlet valve is controlled for a first time period and it is determined when the first time period is complete whether a predetermined test amount of water has flowed through the water inlet valve. If a predetermined test amount of water has flowed through the water inlet valve, the water inlet valve is operated in a first operation mode. On the other hand, if less than the predetermined test amount of water has flowed through the water inlet valve, the water inlet valve is operated in a second operation mode with a reduced long-term load.

20 Claims, 2 Drawing Sheets

WATER-BEARING HOUSEHOLD APPLIANCE WITH A PERIODICALLY OPERATED WATER INLET VALVE

BACKGROUND OF THE INVENTION

The present invention relates to a water-conducting household appliance.

It is normally provided that water-conducting household appliances are permanently connected to a water supply system at the house end. Conventional water-conducting household appliances have an electromagnetic water inlet valve for controlling the water intake. Each time the appliance is filled, the water inflow is started up in a program-controlled manner. To this end, the water inlet valve is actuated so that it opens. As soon as water flows through the water inlet valve, this water automatically brings about cooling of the magnetic coil of the water inlet valve. Normally, the water inlet valve is actuated until such time as a predefined quantity of water has run into the appliance, e.g. until a desired fill level is reached. If, however, no water is available from the water supply system, e.g. because a main stopcock at the house end of the water supply system is turned off, the water inlet valve in conventional household appliances is continuously actuated, even though no water is flowing through. Since no water is available for cooling, the magnetic coil heats up excessively, and malfunctions of the water inlet valve or even its destruction might result.

Overheating can be avoided either through improved cooling or reduction of the power loss in the magnetic coil. Improvements in the cooling can, however, be achieved only with difficulty due to the arrangement of the components, and a reduction in the power loss by reducing ohmic losses leads to additional costs in respect of the water inlet valves.

BRIEF SUMMARY OF THE INVENTION

The object of the present invention is to provide a water-conducting household appliance with a water inlet valve, which eliminates at least in part the stated disadvantages of the prior art.

This object is achieved in a water-conducting household appliance having a water inlet valve according to the accompanying independent claims. The subclaims relate to preferred embodiments which can be used singly or in combination with one another.

The present invention relates in particular to a water-conducting household appliance, e.g. a dishwasher or a washing machine, having a water intake system and an electrically operable electromagnetic water inlet valve for controlling the water intake, and a control unit to which a control program defining the actuation of the water inlet valve is assigned, it being provided according to the invention that the control program is designed such that the water inlet valve is actuated for a first time period, and it is determined after expiration of the first time period whether a predefined test water quantity has flowed through the water inlet valve. In the case that the predefined test water quantity has flowed through the water inlet valve, the water inlet valve is operated in a first operating mode. In the case that the predefined test water quantity has not, or has not fully, flowed through the water inlet valve, the water inlet valve is operated in a second operating mode with reduced continuous loading compared to the first operating mode.

The core of the invention lies in the provision of a cyclically operated control of the electromagnetic water inlet valve. To this end, the control program is designed such that it comprises two operating modes, it being possible to switch between the two operating modes.

The first operating mode comprises an operation that is already known in the prior art. That is, the water inlet valve is actuated until such time as a predefined operating water quantity is reached.

The operating water quantity is the fill quantity which is needed for washing. This may differ depending on the type of water-conducting household appliance (washing machine, dishwasher, etc.) and depending on the wash program specifically to be carried out.

The second operating mode comprises a cyclical actuation of the water inlet valve, for example, with square-wave pulses. Here, the water inlet valve is, for example, alternately not actuated for a second period t2 and actuated for a third period t3 so as to reduce the continuous loading on the water inlet valve and thereby the generation of heat. As an alternative to such a cyclical actuation with square-wave pulses, other appropriate actuation signals, such as e.g. trapezoidal, ramp-shaped or (semi-)sinusoidal actuation signals, can also be used.

In the case of the water inlet valve according to the invention, the control program is designed such that the valve is initially actuated for a predefined time period t1. This time period t1 should as a rule be longer than the time period which is needed, given a normal water intake, for a predefined test water quantity to be supplied.

t1 is preferably 1.5 to 3 times as long as the time period needed for the test water quantity to be reached. It is particularly preferably 1.8 to 2.5 times as long, and particularly preferably approximately twice as long.

It is determined during the time period t1 whether water has flowed through the valve. To achieve this, a test water quantity is predefined and it is determined whether this has been reached during or at the end of the time period t1. The test water quantity is therefore chosen so as to be less than the operating water quantity.

The determination of whether a test water quantity has been reached can be carried out by various devices. On the one hand, a water fill level can be measured, or the water pressure can be determined. Alternatively, the volume can also be determined, for example by means of an impeller flow meter.

It can either be determined only at the end of the time period t1 whether the test water quantity has been reached or not, or it can be determined continuously whether the test water quantity has been reached. The continuously actuating operating mode is continued if water is available in the fresh water system and consequently the test water quantity has been reached.

If this is not the case because e.g. the main stopcock of the water supply system at the house end is turned off, a switchover to cyclical operating mode occurs. In this mode it can likewise be determined at intervals or continuously whether a test water quantity has in the meantime been reached. If this can be answered in the affirmative, then there are two variants. Either a return to the first operating mode can be effected or operation can be continued in the cyclical second operating mode.

The ratio of t3/(t3+t2) corresponds to the so-called duty cycle of intermittent operation ABED. The ABED should preferably lie at approximately 50%, which means that t2 and t3 are approximately equal in length. Both t2 and t3 lie in the range from fractions of seconds up to 1 second or else up to several seconds, e.g. up to about 5 seconds.

It is advantageous to keep the time periods t2 in which the valve is not actuated as short as possible in order that as little idle time as possible arises for the operator and so as to avoid confusion as to whether the device is in operation or not. The time period t2 should therefore, if possible, not exceed a duration of approximately 1 second, but it can also be a few seconds, for example 2, 3, 4 or 5 seconds, long.

A water inlet valve with a control device according to the present invention has the advantage that even in cases of disruption, such as, for example, if there is a shortage of water in the water supply system at the house end, overheating of the magnetic coil is prevented.

A further aspect of the present invention is a method for controlling a water inlet valve for a water-conducting household appliance, characterized in that the water inlet valve is actuated for a first time period t1, and it is determined after expiration of first time period t1 whether a predefined test water quantity has flowed through the water inlet valve, and that in the case that the predefined test water quantity has flowed through the water inlet valve, the water inlet valve is operated in a first operating mode, and that in the case that the predefined test water quantity has not, or has not fully, flowed through the water inlet valve, the water inlet valve is operated in a second operating mode.

It is preferably provided that the control program is designed such that the water inlet valve is operated with continuous actuation if a predefined test water quantity has been reached.

It is furthermore preferably provided that the control program is designed such that the water inlet valve is operated in a second operating mode if an operating water quantity has not been reached. In this way, overheating of the water inlet valve is prevented in the case of operation occurring without the operating water quantity being reached.

It is preferably provided that the control program is designed such that the water inlet valve is operated with continuous actuation for a time period t4 which is 1.5 to 3 times as long as the time period which is needed for the filling of the differential water quantity between the operating water quantity and test water quantity.

BRIEF DESCRIPTION OF THE DRAWINGS

The invention will be explained in detail below on the basis of preferred exemplary embodiments with reference to the drawings, in which.

DETAILED DESCRIPTION OF THE PRESENT INVENTION

Figure 1:
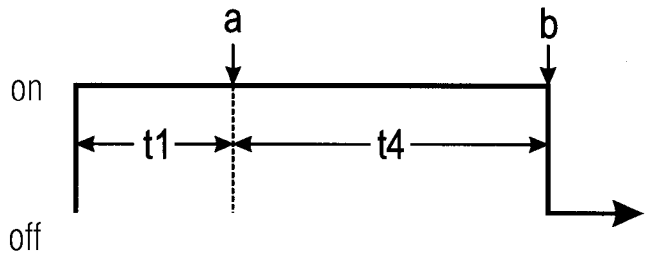
FIGS. 1 to 5 shows schematically the functional principle of a water inlet valve according to the present invention.

FIG. 1 represents schematically the mode of operation of the water inlet valve. Firstly, the device is switched on at the start of operation of a water-conducting household appliance according to the invention. As it is switched on, or shortly thereafter, the water inlet valve is actuated (i.e. it is "on") so as to open it. It is actuated for the time period t1 in order that a predefined test water quantity WM1 can flow through the valve into the device. Whether this test water quantity WM1 has been reached or not is checked at event a. FIG. 1 represents the case that the predefined test water quantity WM1 has been reached. The valve is consequently further actuated in operating mode BM1, in which it is continuously actuated e.g. for the time period t4. The actuation is continued until such time as a predefined water fill quantity operating water quantity WM2 has been reached. This is the case at event b, and the valve is switched off, and no longer actuated ("off").

Figure 2:
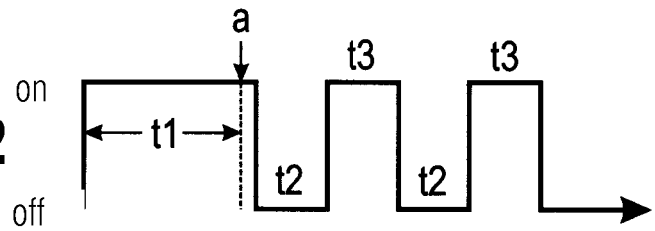

FIG. 2 represents the case that at event a (after expiration of time period t1) the predefined test water quantity WM1 has not been reached. In this case, the valve continues to be operated, shortly after it has been established that the test water quantity WM1 has been reached, in cyclical operating mode BM2. I.e. it is at first not actuated for a time period t2, then actuated again for a time period t3, and so on. Cyclical operation can now be continued e.g. until the device is switched off at some point.

Figure 3:
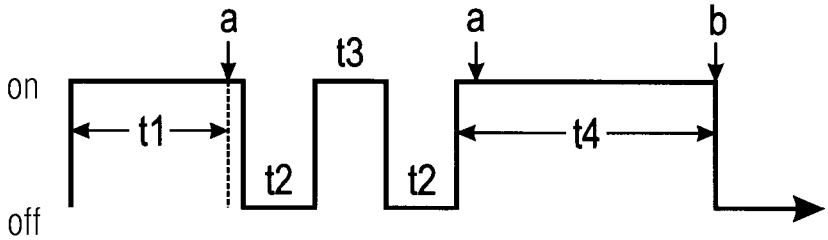

Represented in FIG. 3 is a preferred embodiment from FIG. 2, wherein even in cyclical operating mode BM2 it is checked at intervals or continuously (event a) whether the predefined test water quantity WM1 has in the meantime been reached. In the case shown in FIG. 3, it is actually established at the second event a during cyclical operating mode BM2 that the test water quantity WM1 has been reached. This may, for example, arise if the fresh water system had been switched off previously and is suddenly switched on again. After it has been established that the test water quantity WM1 has been reached, a switch is effected back to BM1, and the valve is actuated until such time as the operating water quantity WM2 is reached, for example after the time period t4 (event b).

Figure 4:
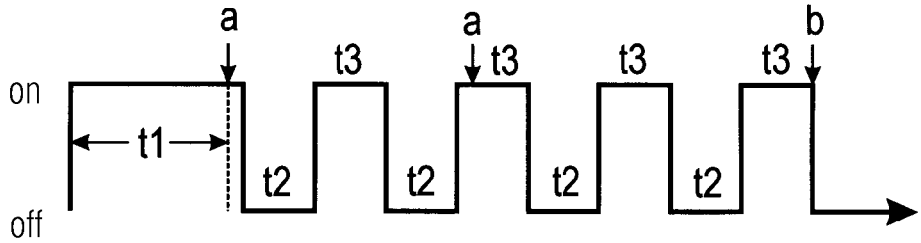

Represented in FIG. 4 is a variant of the operation according to FIG. 3, wherein it is likewise established in operating mode BM2 that water is available again (test water quantity WM1 reached by event a), but operation continues in BM2, until the operating water quantity WM2 is reached by event b.

Figure 5:
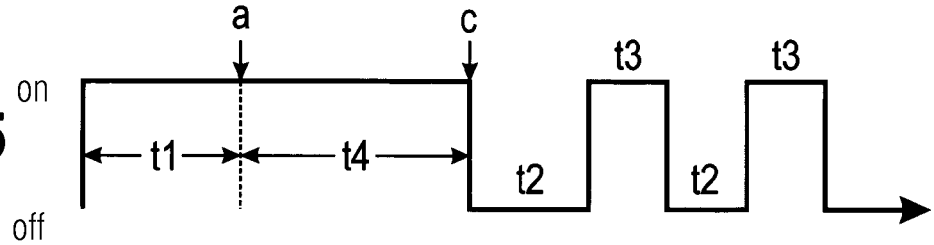

Represented in FIG. 5 is the case that a check has been made at event a as to whether the test water quantity WM1 has been reached. A switchover then occurs to an operating mode with continuous actuation, the time period of which is approximately 1.5 to 3 times as long as the time period that is needed for the filling of the differential water quantity between the operating water quantity WM2 and the test water quantity WM1. It is established at event c that the operating water quantity WM2 has not been reached, and operation is continued with cyclical actuation.

Figure 6:
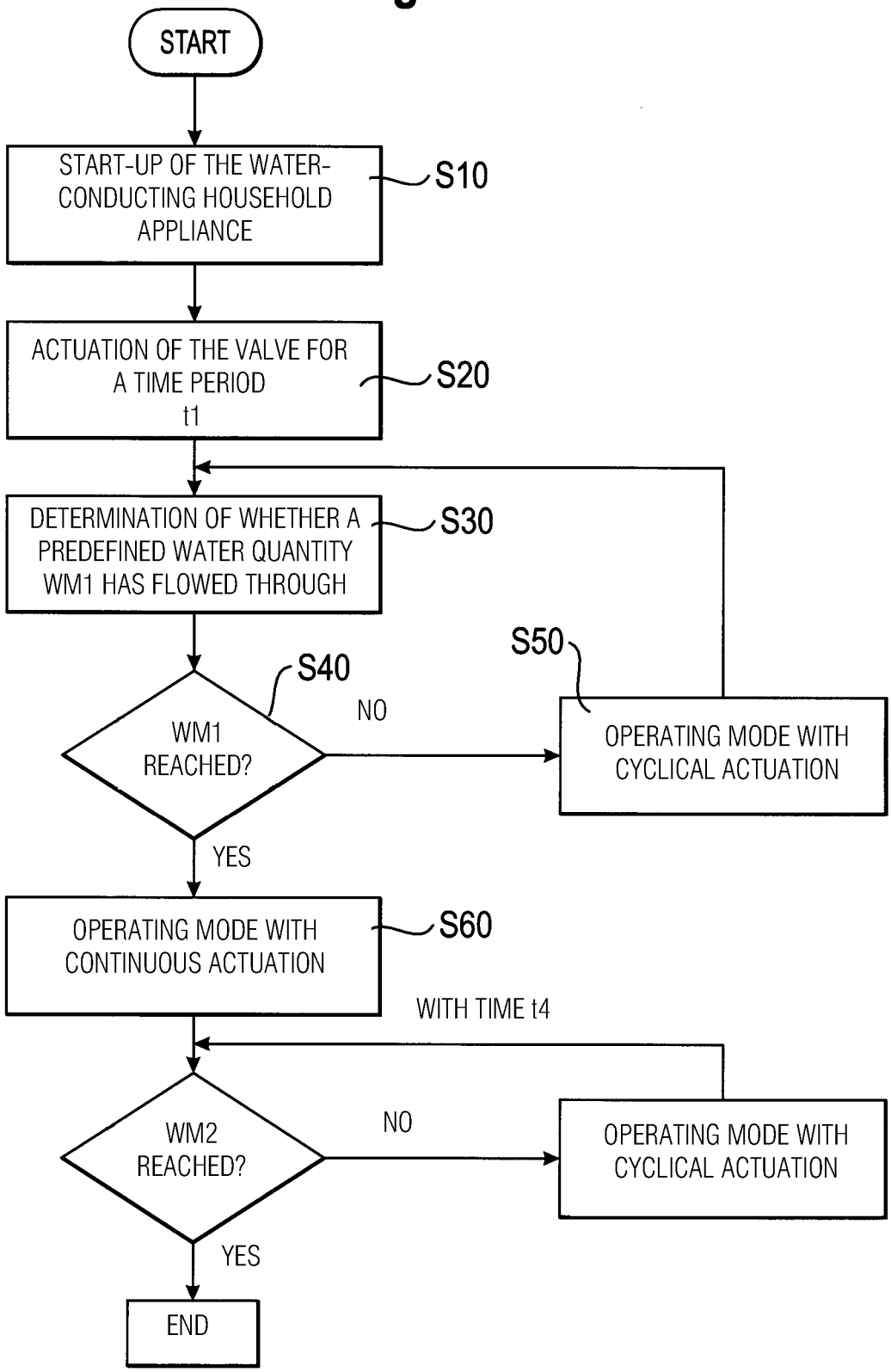
FIG. 6 shows a flow diagram of the method for operating a water inlet valve according to the present invention, In the description of the figures below, identical reference characters designate identical or comparable elements or events.

FIG. 6 shows a flow diagram of a method according to the invention. In step S10, the water-conducting household appliance is switched on. Directly thereafter, or after a time period, the water inlet valve is actuated for a time period t1 (step S20). In step S30, it is determined whether a predefined test water quantity WM1 has been reached or not. If the answer in step S40 is in the negative, then a switchover is made to step S50, cyclical operating mode. If the answer is in the affirmative, then operation continues in step S60 in continuous actuation mode.

LIST OF REFERENCE CHARACTERS

S10 Start-up of the water-conducting household appliance
S20 Actuation of the valve for a time period t1
S30 Determination of whether a predefined test water quantity WM1 has flowed through
S40 Yes/no query as to whether test water quantity WM1 has been reached
S50 Operation of the valve in cyclical operating mode
S60 Operation of the valve in operating mode with continuous actuation
t1 Time period t1 for which the valve is initially actuated when the appliance is being filled and after expiration of which it is determined whether the test water quantity WM1 has been reached or not t2 predefined time period of non-actuation in operating mode 2 t3 predefined time period of actuation in operating mode 2 t4 time period by which operating water quantity WM2 has to be reached a Event: query as to whether test water quantity WM1 has been reached or not b Event: reaching of operating water quantity WM2 c Event: query as to whether operating water quantity WM2 has been reached or not

The invention claimed is:

1. A water-conducting household appliance, comprising:

a water intake system;

an electrically operable electromagnetic water inlet valve structured for cyclical actuation for controlling the water intake; and a control unit, the control unit being operable to execute a control program to control the actuation of the water inlet valve according to which the water inlet valve is actuated for a first time period, a determination is made after expiration of the first time period whether a predefined test water quantity has flowed through the water inlet valve, and, in the event that the predefined test water quantity has flowed through the water inlet valve, the water inlet valve is operated in a first operation mode, and, in the event that less than the predefined test water quantity has flowed through the water inlet valve, the water inlet valve is operated in a second operating mode with the cyclical actuation and reduced continuous loading compared to the first operating mode.

2. The water-conducting household appliance as claimed in claim 1, wherein the control unit executes the control program such that, in the second operating mode, a further determination is made as to whether a predefined test water quantity has flowed through the water inlet valve and, in the event that the predefined test water quantity has flowed through the water inlet valve, the water inlet valve is operated in the first operating mode, and, in the event that less than the predefined test water quantity has flowed through the water inlet valve, the water inlet valve is operated in the second operating mode.

3. The water-conducting household appliance as claimed in claim 1, wherein the control unit executes the control program such that, in the second operating mode, a further determination is made as to whether a predefined test water quantity has flowed through the water inlet valve and the water inlet valve is further operated in the second operating mode.

4. The water-conducting household appliance as claimed in claim 1, wherein the first time period is longer than a predefined time period needed until the test water quantity is reached.

5. The water-conducting household appliance as claimed in claim 1, wherein the control unit executes the control program such that the water inlet valve is operated with continuous actuation if a predefined test water quantity has been reached.

6. The water-conducting household appliance as claimed in claim 5, wherein the control unit executes the control program such that the water inlet valve is operated in the second operating mode if an operating water quantity has not been reached.

7. The water-conducting household appliance as claimed in claim 5, wherein the control unit executes the control program such that the water inlet valve is operated with continuous actuation for a time period which is 1.5 to 3 times as long as the time period that is needed for filling the differential water quantity between the operating water quantity and the test water quantity.

8. The water-conducting household appliance as claimed in claim 1, wherein the control unit executes the control program such that, in the first operating mode, the water inlet valve is further actuated until such time as a predefined operating water quantity is reached and such that, in the second operating mode, the water inlet valve is controlled with the cyclical actuation.

9. The water-conducting household appliance as claimed in claim 8, wherein the control unit executes the control program such that, in the second operating mode, the water inlet valve is operated to repeat a cycle of not being actuated for a given time period and being actuated for a given time period.

10. The water-conducting household appliance as claimed in claim 9, wherein, in the cycle of the water inlet valve not being actuated for a given time period and being actuated for a given time period, the given time period of the water inlet valve not being actuated and the given time period of the water inlet valve being actuated are each 1.5 to 3 times longer than a predefined time period needed until the test water quantity is reached.

11. The water-conducting household appliance as claimed in claim 9, wherein, in the cycle of the water inlet valve not being actuated for a given time period and being actuated for a given time period, the given time period of the water inlet valve not being actuated and the given time period of the water inlet valve being actuated are approximately equal in length.

12. The water-conducting household appliance as claimed in claim 9, wherein, in the cycle of the water inlet valve not being actuated for a given time period and being actuated for a given time period, the given time period of the water inlet valve not being actuated is from 0.5 to 2 seconds in length.

13. A method, for a water-conducting household appliance, that executes a control program to control actuation of a water inlet valve in at least one of a first operation mode and a second operation mode based on whether a predefined test water quantity has flowed through the water inlet valve, the method comprising:

actuating the water inlet valve for a first time period;

determining, after expiration of the first time period, whether the predefined test water quantity has flowed through the water inlet valve; and operating the water inlet valve in the first operation mode when the predefined test water quantity has flowed through the water inlet valve; and operating the water inlet valve in the second operating mode with cyclical actuation and reduced continuous loading compared to the first operating mode when less than the predefined test water quantity has flowed through the water inlet valve.

14. The method as claimed in claim 13 and further comprising, in the event that the predefined test water quantity has flowed through the water inlet valve, further actuating the water inlet valve in the first operating mode until such time as a predefined operating water quantity is reached, and, in the second operating mode, controlling the water inlet valve with the cyclical actuation.

15. The method as claimed in claim 14 and further comprising, in the second operating mode, operating the water inlet valve to repeat a cycle of not being actuated for a given time period and being actuated for a given time period.

16. The method as claimed in claim 14 and further comprising, in the second operating mode, making a further determination as to whether a predefined test water quantity has flowed through the water inlet valve and, in the event that the predefined test water quantity has flowed through the water inlet valve, the water inlet valve is operated in the first operating mode, and, in the event that less than the predefined test water quantity has flowed through the water inlet valve, the water inlet valve is operated in the second operating mode.

17. The method as claimed in claim 14 and further comprising, in the second operating mode, making a further determination to whether a predefined test water quantity has flowed through the water inlet valve and the water inlet valve is further operated in the second operating mode.

18. The method as claimed in claim 14, wherein the water inlet valve is operated with continuous actuation if a predefined test water quantity has been reached.

19. The method as claimed in claim 14, wherein the water inlet valve is operated in a second operating mode if an operating water quantity has not been reached.

20. The method as claimed in claim 19, wherein the water inlet valve is operated with continuous actuation for a time period which is 1.5 to 3 times as long as the time period that is needed for filling the differential water quantity between the operating water quantity and the test water quantity.

* * * * *